US006549177B2

(12) United States Patent
Noro et al.

(10) Patent No.: US 6,549,177 B2
(45) Date of Patent: Apr. 15, 2003

(54) ANTENNA UNIT HAVING A HELICAL ANTENNA AS AN ANTENNA ELEMENT

(75) Inventors: Junichi Noro, Akita (JP); Akemi Kato, Akita (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 09/946,203

(22) Filed: Sep. 5, 2001

(65) Prior Publication Data

US 2002/0030633 A1 Mar. 14, 2002

(30) Foreign Application Priority Data

Sep. 7, 2000 (JP) ..... 2000-271074

(51) Int. Cl.[7] ..... H01Q 1/24
(52) U.S. Cl. ..... 343/895; 343/702
(58) Field of Search ..... 343/895, 702, 343/700 MS, 841; 455/90

(56) References Cited

U.S. PATENT DOCUMENTS 5,691,726 A * 11/1997 Nichols et al. ..... 342/357
6,271,803 B1 * 8/2001 Watanabe et al. ..... 343/895
6,342,869 B1 * 1/2002 Edvardsson et al. ..... 343/841

FOREIGN PATENT DOCUMENTS

JP 9-236650 A 9/1997

* cited by examiner

*Primary Examiner*—Don Wong
*Assistant Examiner*—James Clinger
(74) *Attorney, Agent, or Firm*—Frishauf, Holtz, Goodman & Chick, P.C.

(57) ABSTRACT

In an antenna unit (10) comprising a circuit board (11) having a principal surface (11*a*) and a back surface (11*b*) and an antenna element (12) mounted on the principal surface of the circuit board, a helical antenna having an axial direction extending in substantially parallel with the principal surface is used ad the antenna element (12). A shield cover (13) is added to the circuit board at the back surface (11*b*) so as to cover circuit elements (17) and shields the circuit elements arranged on the back surface of the circuit board. An output cable (14) is connected to the circuit elements inside the shield cover and is pulled out of the shield cover. The circuit elements include a low-noise amplifier (LNA) circuit (172).

6 Claims, 5 Drawing Sheets

ANTENNA UNIT HAVING A HELICAL ANTENNA AS AN ANTENNA ELEMENT

BACKGROUND OF THE INVENTION

This invention relates to an antenna unit used as a GPS (Global Positioning System) antenna.

As well known in the art, a GPS receiver is an apparatus for detecting a current position of a mobile station for a user by receiving electric waves radiated on an earth from a plurality of GPS (Global Positioning System) satellites which go over the earth.

As well known in the art, the GPS (Global Positioning System) is a satellite positioning system using military satellites under Department of Defense in Unite States control that comprise twenty-four non-geostationary satellites in total in six orbit surfaces every four satellites at an orbit height of about 20,000 km. The above-mentioned non-geostationary satellites (military satellites) are called GPS satellites. If the GPS receiver receives electric waves from four GPS satellites, it is possible to carry out a three-dimensional positioning. In this connection, if the GPS receiver receives electric waves from three GPS satellites, it is possible to carry out a two-dimensional positioning.

In other words, the GPS is a global positioning system comprising twenty-four artificial satellites launched by Department of Defense in United States, a control station on earth, and mobile stations for users. By using the global positioning system, it is possible to calculate a position, a moving direction, and a moving speed of the mobile station by measuring distances between the mobile station and three or more GPS satellites on the basis of time intervals taken for arrival of the electric waves. Although the global positioning system is originally used for military affairs, presently, it is widely applied to car navigation systems or the like. In addition, the mobile stations may be not only automobiles but also airplanes, ships, or the like.

Now, "car navigation" means to provide a driver information by displaying a position of a driver's driving car on a map of a car mounted machine at a real time, by displaying road traffic information, and by calculating the most suitable route up to a driver's destination.

A current used car navigation system calculates a latitude, a longitude, a height, and a time instant on capturing four or more GPS satellites and calculates the latitude, the longitude, and the time instant with the height fixed on capturing only three GPS satellites. In addition, the current used car navigation system calculates the latitude and the longitude using a time instant of an internal clock with the height fixed on capturing only two GPS satellites. Furthermore, the current used car navigation system carries out an error indication on capturing only one GPS satellite or no GPS satellite (see Japanese Unexamined Patent Publication Tokkai No. Hei 9-236650 or JP-A 9-236650.

Now, inasmuch as an electric wave called a GPS signal, which is generated by the GPS satellite and is arrived on the ground, has a very weak strength, the GPS signal may be buried in or covered with noises of electric waves on the ground. Accordingly, as the GPS signal, a PSK (Phase Shift Keying) wave which spread spectrum modulated by using a PN (Pseudo Noise) code is used and the GPS receiver comprises a LNA (Low Noise Amplifier) circuit for extracting the GPS signal from the noises and for amplifying an extracted GPS signal.

Attention will be directed to the car navigation system where the mobile station is a car or an automobile. In this event, a GPS antenna (or an antenna unit) is mounted on an outer surface of a body of the car by using magnets or the like. Specifically, it will be assumed that the GPS antenna (or the antenna unit) is a planer-type antenna. The planer-type antenna may be mounted on a metallic roof panel of the car or the like by magnetically attracting the planer-type antenna to the metallic roof panel. The GPS antenna (or the antenna unit) comprises an antenna element and a circuit board on which accompanied circuit elements including the above-mentioned LNA circuit are mounted. The planer-type antenna is called a patch antenna in the art.

In the manner which will later be described in conjunction with FIG. 3, the planer-type antenna has almost no gain (directivity) in a horizontal direction. Accordingly, it is difficult or unsuitable to mount the planer-type antenna on an inclined place.

SUMMARY OF THE INVENTION

It is therefore an object of the present invention to provide an antenna unit which is capable of mounting the antenna unit on not only a horizontal place but also an inclined place such as a rear window or a front window of a car.

Other objects of this invention will become clear as the description proceeds.

According to a first aspect of this invention, an antenna unit comprises a circuit board on which circuit elements are mounted. The circuit board has a principal surface. Mounted on the principal surface of the circuit board, an antenna element is connected to the circuit elements. The antenna element comprises a helical antenna having an axial direction which extends in a direction in substantially parallel to the principal surface of said circuit board.

According to a second aspect of this invention, an antenna unit comprises a circuit board having a principal surface and a back surface opposite to the principal surface. Circuit elements are arranged on the back surface of the circuit board. Mounted on the principal surface of the circuit board, an antenna element is connected to the circuit elements. The antenna element comprises a helical antenna having an axial direction which extends in a direction in substantially parallel to the principal surface of the circuit board. Added to the back surface of the circuit board so as to cover the circuit elements, a shield cover shields the circuit elements.

According to a third aspect of this invention, an antenna unit comprises a circuit board having a principal surface and a back surface opposite to the principal surface. Circuit elements are arranged on the back surface of the circuit board. Mounted on the principal surface of the circuit board, an antenna element is connected to the circuit elements. The antenna element comprises a helical antenna having an axial direction which extends in a direction in substantially parallel to the principal surface of the circuit board. Added to the back surface of the circuit board so as to cover the circuit elements, a shield cover shields the circuit elements. An output cable is connected to the circuit elements inside the shield cover. The output cable is pulled out of the shield cover.

DESCRIPTION OF THE PREFERRED EMBODIMENT

Figure 1:
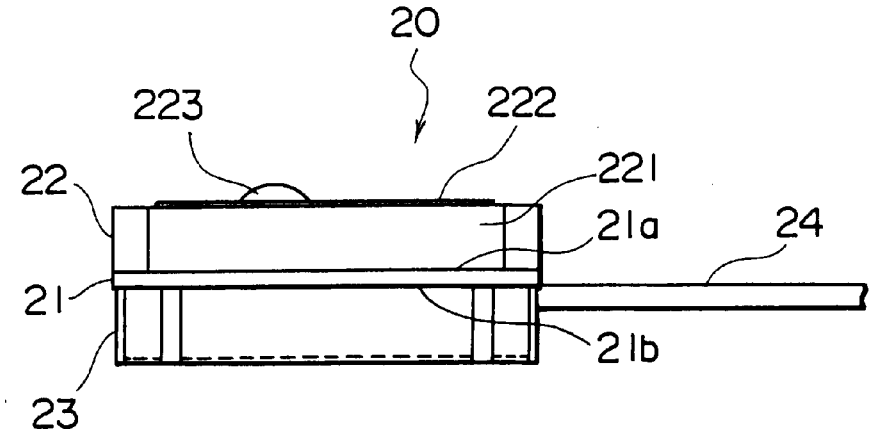
FIG. 1 is a schematic side view showing an antenna body of a planer-type antenna which is used as an existing GPS antenna.
Figure 2:
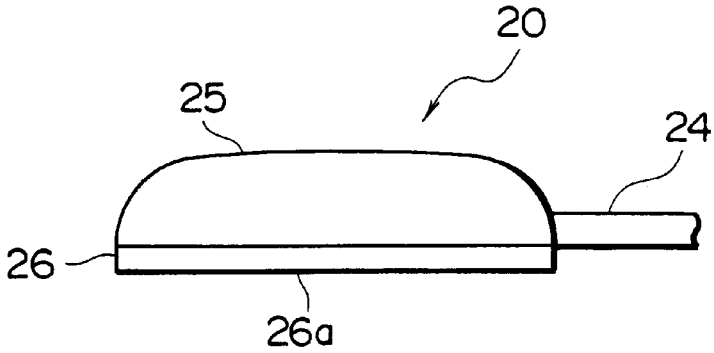
FIG. 2 is a schematic side view showing the exterior of the planer-type antenna illustrated in FIG. 1.

Referring to FIGS. 1 and 2, the description will proceed to a basic structure of a general planer-type antenna 20 which is used as a GPS antenna. FIG. 1 is a schematic side view showing an antenna body of the planer-type antenna 20. FIG. 2 is a schematic side view showing the exterior of the planer-type antenna 20.

As shown in FIG. 1, the antenna body of the planer-type antenna 20 comprises a circuit board 21 having an upper (a principal) surface 21*a* and a lower (back) surface 21*b*, an antenna element 22, an a shield cover 23. The circuit board 21 has an upper surface (a principal surface) 21*a* and a lower surface (a back surface) 21*b* opposite to the upper surface 21*a*. Circuit elements (not shown) including a low-noise amplifier (LNA) circuit are mounted or arranged on the lower surface (back surface) 21*b* of the circuit board 21. The antenna element 22 is mounted on the upper surface (principal surface) 21*a* of the circuit 21 and is connected to the circuit elements. The shield cover 23 is added to the lower surface 21*b* of the circuit board 21 so as to cover the circuit elements and is for shielding the circuit elements. In addition, an output cable (a coaxial cable) 24 is pulled out of the circuit elements through the shield cover 23.

The antenna body, which comprises the circuit board 21, the antenna element 22, and the shield cover 23) is received between an upper case 25 and a lower case 26 as shown in FIG. 2. The output cable 24 is pulled between the upper and the lower cases 25 and 26 through a gap (not shown) to the exterior of the planer-type antenna 20 and may be connected to a receiver body (not shown) of a GPS unit.

In addition, the lower case 26 has a bottom surface 26*a* on which permanent magnets (not shown) are mounted to enable the planer-type antenna 20 to magnetically attract on a surface of a roof panel of a car. The principal surface 21*a* of the circuit board 21 and the bottom surface 26*a* of the lower case 26 substantially extend to be parallel with each other. Accordingly, the principal surface 21*a* of the circuit board 21 in the planer-type antenna 20 substantially extends along a horizontal direction.

In addition, the antenna element 22 comprises a ceramic body 221 having a substantial rectangular shape, a reception surface 222 mounted on an upper surface of the ceramic body 221, and a feeding pin 223. The feeding pin 223 penetrates the ceramic body 221 and the reception surface 222 to connect the reception surface 222 with the circuit elements. The antenna element 22 having such a structure is called a "patch antenna" in the art.

Figure 3:
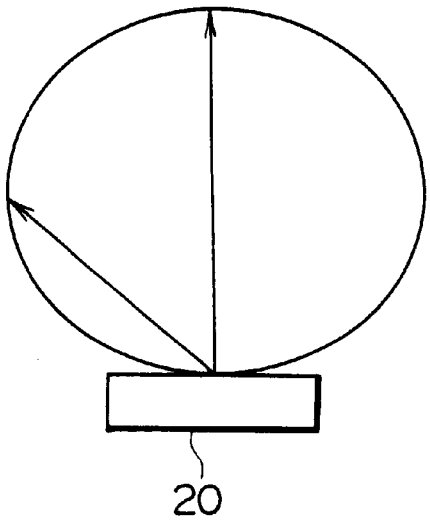
FIG. 3 is a view showing a radiation pattern (directional pattern) indicative of directive of the planer-type antenna (patch antenna)

Now, the planer-type antenna 20 (the patch antenna 22) illustrated in FIGS. 1 and 2 has a directivity as shown in FIG. 3. More specifically, the planer-type antenna 20 has a radiation pattern (a directional pattern) which has the largest value (the maximum gain) in a vertical direction to the principal surface 21*a* of the circuit board 21. However, it is seen that the radiation pattern (directional pattern) of the planer-type antenna 20 has almost no gain (directivity) in a direction in parallel with the principal surface 21*a* of the circuit board 21. This means that the planer-type antenna 20 cannot receive any electric wave in the direction in parallel with the principal surface 21*a* of the circuit board 21 (i.e. any electric wave having an angle of elevation of zero from GPS satellites).

On the other hand, as described above, it is necessary for a car navigation system to capture at least four GPS satellites (or receive GPS signals from the at least four GPS satellites) in order to position an almost collect current position in a mobile station for a user. In addition, inasmuch as the GPS satellites always move, an angle of elevation of the GPS satellite to be captured is not always high.

Accordingly, in order to capture not only the GPS satellites having a high angle of elevation but also the GPS satellites having a low angle of elevation, it is necessary to mount the planer-type antenna 20 on the car so that the principal surface 21*a* of the circuit board 21 is put into as horizontally as possible. This is because it is impossible to receive an electric wave in a direction in parallel with the principal surface 21*a* of the circuit board 21 if the planer-type antenna 20 is mounted or fixed on the car with the principal surface 21*a* of the circuit board 21 slanted off the horizontal. Therefore, a mounted place of the existing GPS antenna (planer-type antenna) 20 is restricted to a horizontal position such as the roof panel of the car. In other words, it is unsuitable and not desirable that the planer-type antenna 20 is mounted on an inclined place such as a rear window or a front window of the car.

Users for the car navigation systems wish that an antenna unit (GPS antenna) may be mounted not only on such as a horizontal place but also on an inclined place and want degrees of freedom as regards the mounted place.

The present inventors have been made extensive studies and considered various ideas in order to achieve a structure which enables an antenna unit to be mount not only on a horizontal place but also on an inclined place. As described above, inasmuch as the existing antenna element (patch antenna) has the radiation pattern (directional pattern) which has the largest value (the maximum gain) in a vertical direction to the principal surface of the circuit board and which has almost no gain (directivity) in a horizontal direction, it is practically difficult to mount the planer-type antenna with the planer-type antenna put into an inclined state. Accordingly, the present inventors arrived at an idea to use, as the antenna element, ones having a gain (directivity) in a direction in parallel with the principal surface of the circuit board and having a different directivity compared with the existing one.

So, the present inventors looked for candidacy for an antenna element having such as a directivity. The present inventors realized that a helical antenna is suitable for the candidacy. This is because the helical antenna has a radiation pattern (directional pattern) which has the largest value (the maximum gain) in an inclined direction to an axis (a slant transverse) without in an axial direction (longitudinal) of the helical antenna. In addition, the helical antenna comprises a cylindrical member made of insulator and at least one antenna lead wound around an outer peripheral surface of the cylindrical member in a helix fashion. Accordingly, the present inventors arrived at a conclusion that if the helical antenna is mounted on a circuit board so that the helical antenna has an axial direction in parallel with a principal surface of the circuit board, such an antenna unit ought to have a gain (directivity) in a direction in parallel with the principal surface of the circuit board (in the axial direction of the helical antenna).

Figure 4:
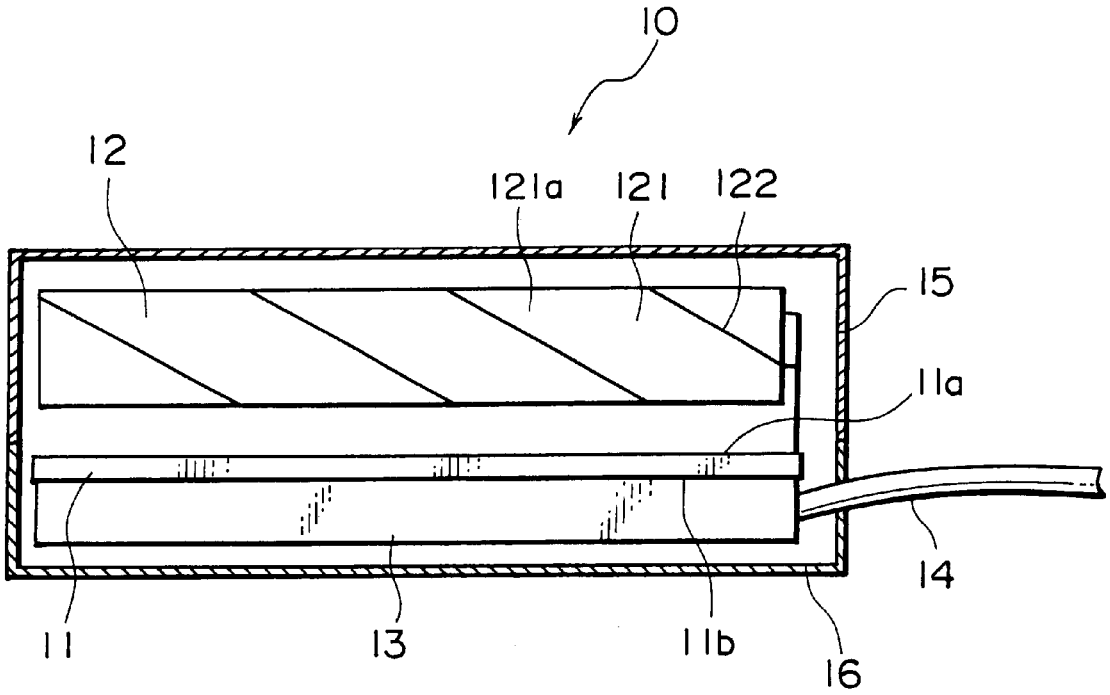
FIG. 4 is a schematic sectional side view showing an antenna unit (GPS antenna) according to an embodiment of this invention.
Figure 5:
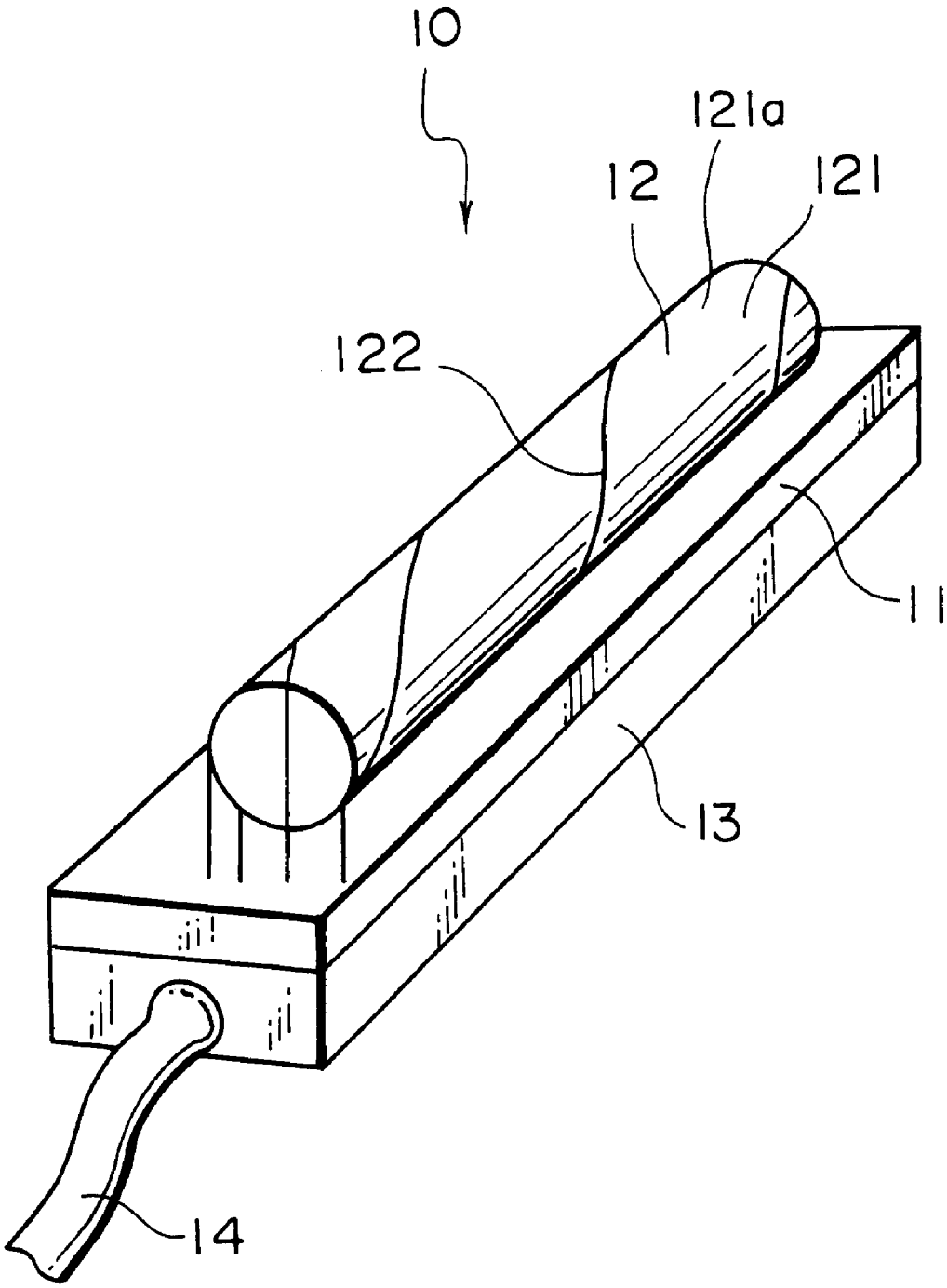
FIG. 5 is a schematic perspective view showing an antenna body of the antenna unit illustrated in FIG. 4.
Figure 6A:
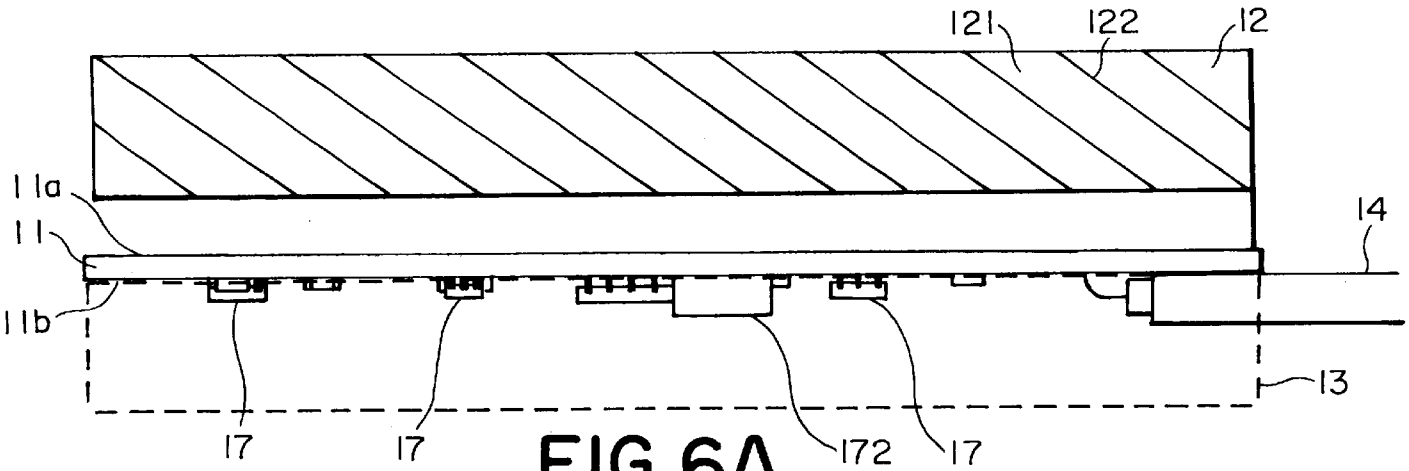
FIG. 6A is a side view showing the antenna body illustrated in FIG. 5.
Figure 6B:
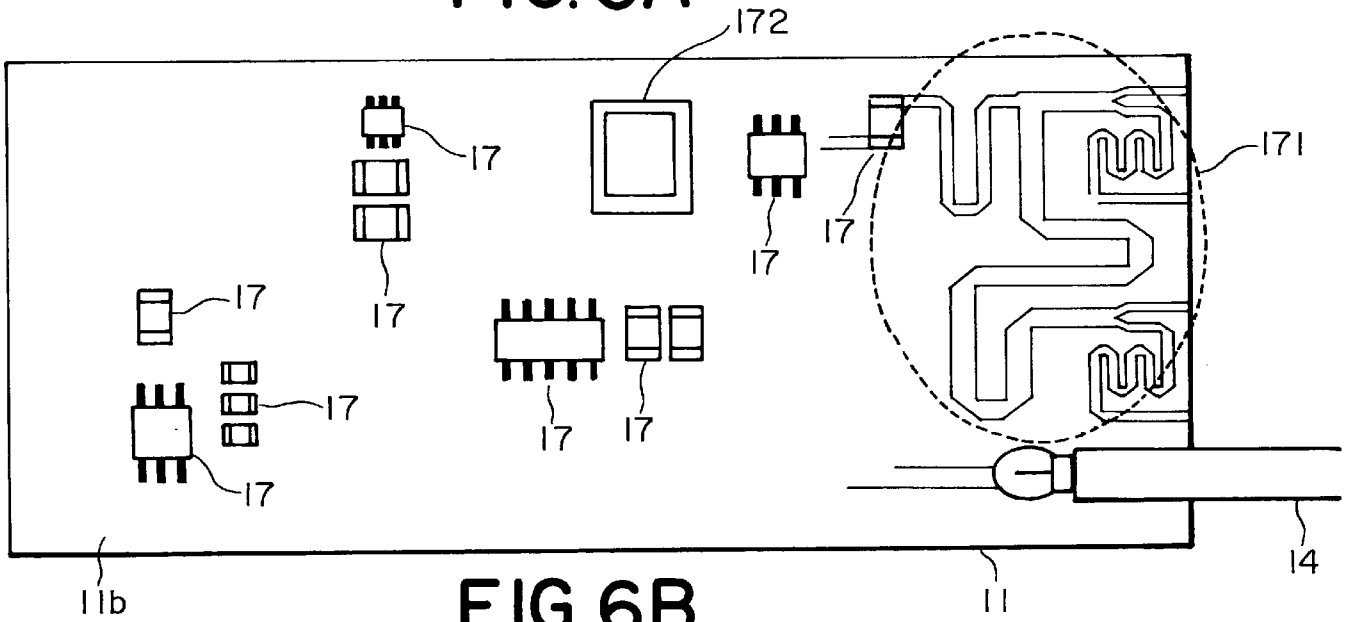
FIG. 6B is a bottom view showing the antenna body illustrated in FIG. 6A.

Referring to FIGS. 4, 5, 6A, and 6B, the description will proceed to an antenna unit 10 according to a preferred embodiment of this invention. FIG. 4 is a schematic sectional view showing the antenna unit 10. FIG. 5 is a schematic perspective view showing an antenna body of the antenna unit 10. FIG. 6A is a side view showing the antenna body illustrated in FIG. 5. FIG. 6B is a bottom view showing the antenna body illustrated in FIG. 6A. The illustrated antenna unit 10 is used as a GPS antenna of a GPS receiver for use in a car navigation system.

The antenna unit 10 comprises a circuit board 11, an antenna element 12, a shield cover 13, and an output cable (a coaxial cable) 14. The circuit board 11 has an upper surface (a principal surface) 11*a* and a lower surface (a back surface) 11*b* opposite to the upper surface 11*a*.

As shown in FIGS. 6A and 6B, various circuit elements 17 including a phase shifter circuit 171, a low-noise amplifier (LNA) circuit 172, and so on are mounted or arranged on the lower surface (back surface) 11*b* of the circuit board 11. The antenna element 12 is mounted on the upper surface (principal surface) 11*a* of the circuit board 11 and is connected to the circuit elements 17. The shield cover 13 is added to the lower surface 11*b* of the circuit board 11 so as to cover the circuit elements 17 and is for shielding the circuit elements 17. The output cable (coaxial cable) 14 is pulled out of the circuit elements 17 to the exterior through the shield cover 13. A combination of the circuit board 11, the antenna element 12, and the shield cover 13 serves as the antenna body received between an upper case 15 and a lower case 16 both of which are made of resin. The output cable 14 is pulled out of the lower case 16 to the exterior through a gap (not shown) and is connected to a receiver body (not shown) of the GPS receiver.

According to this invention, a four-phase helical antenna is used as the antenna element 12. More specifically, the four-phase helical antenna 12 comprises a cylindrical member 121 made of insulator. The cylindrical member 121 may be called a bobbin or a cylindrical dielectric core. The cylindrical member 121 has an outer peripheral surface 121*a*. The four-phase helical antenna 12 further comprises four antenna leads 122 which are wound around the outer peripheral surface 121*a* of the cylindrical member 121 in a helix fashion. The four-phase helical antenna 12 is mounted on the principal surface 11*a* of the circuit board 11 so that four-phase helical antenna 12 has an axial direction in substantially parallel with the principal surface 11*a* of the circuit board 11. In addition, in the manner known in the art, the helical antenna may receive circular polarization.

The four antenna leads 122 are connected to the phase shifter circuit 171. After the GPS signal from the GPS satellite is received by the four antenna leads 122 as four received waves, the four received waves are phase shifted and combined by the phase shifter circuit 171 so as to match phases of the four received waves to obtain a combined wave, and then the combined wave is amplified by the low-noise amplifier (LNA) circuit 172 to obtain an amplified wave.

In addition, the antenna element 12 may comprise a single-phase helical antenna having only one antenna lead. In this event, the phase shifter circuit 171 is removed from the circuit elements 17.

Figure 7A:
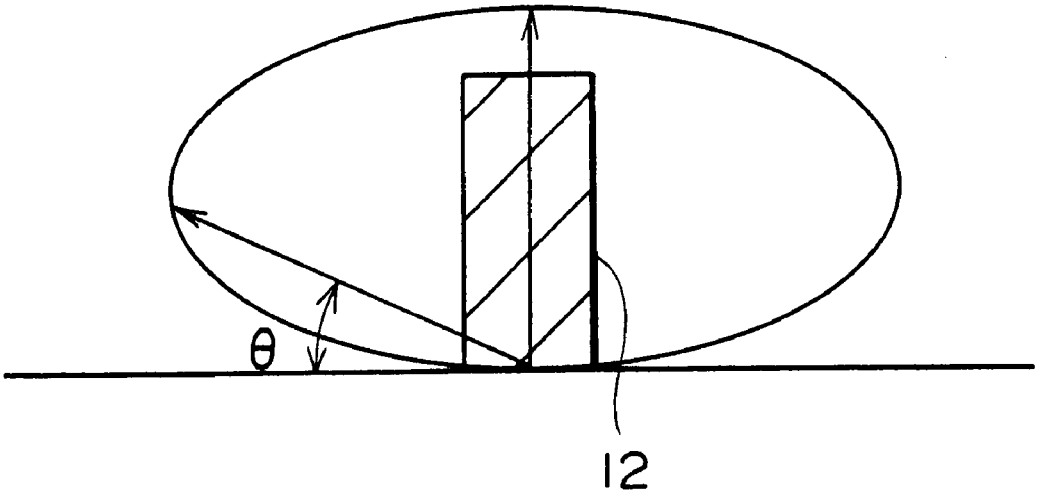
FIG. 7A illustrates a radiation pattern (directional pattern) of a four-phase helical antenna in a state where the four-phase helical antenna is stood up.
Figure 7B:
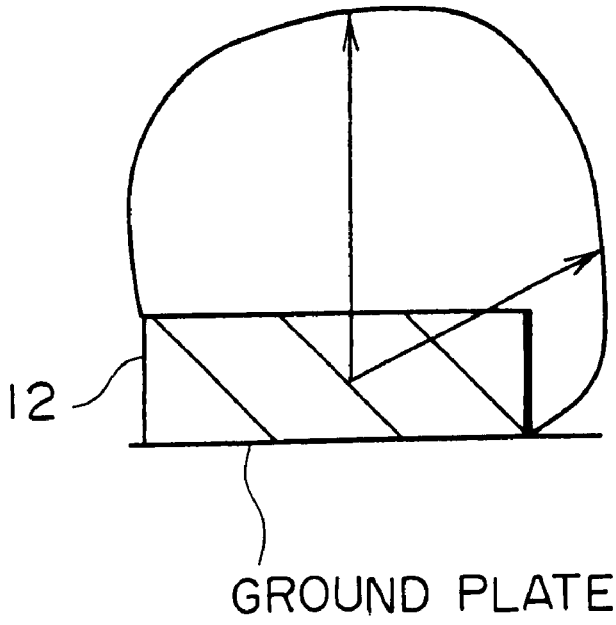
FIG. 7B illustrated the radiation pattern (directional pattern) of the fore-phase helical antenna in a state where the four-phase helical antenna is brought down.

Referring to FIGS. 7A and 7B, attention will be directed to a radiation pattern (directional pattern) of the four-phase helical antenna 12. FIG. 7A illustrates the radiation pattern (directional pattern) of the four-phase helical antenna 12 in a state where the four-phase helical antenna 12 is stood up. FIG. 7B illustrated the radiation pattern (directional pattern) of the four-phase helical antenna 12 in a state where the four-phase helical antenna 12 is brought down.

As apparent from FIG. 7A, in a case where the four-phase helical antenna 12 is stood up, the four-phase helical antenna 12 has the radiation pattern (directional pattern) having the largest value (the maximum gain) in an inclined direction to the axial direction (slant sidewise) or the inclined direction to a horizontal plane by a predetermined angle θ without the axial direction of the four-phase helical antenna 12 (a vertical direction). In the example being illustrated, the predetermined angle θ is equal to about 30 degrees.

Accordingly, the four-phase helical antenna 12 has a directivity (gain) laterally (that is, in a direction in parallel with the principal surface 12*a* of the circuit board 12 or the axial direction of the four-phase helical antenna 12) although the four-phase helical antenna 12 is brought down to a ground plate as shown in FIG. 6B. Of course, in this state, the four-phase helical antenna 12 has a gain in a vertical direction (in a direction perpendicular to the axial direction of the four-phase helical antenna 12).

In addition, inasmuch as the above-mentioned predetermined angle θ is equal to about 30 degrees, if the antenna unit 10 is fixed on a horizontal place of a car, the antenna unit 10 is operable as a stick-shaped GPS antenna having directivity with the maximum gain in a direction at an angle of elevation of about 60 degrees.

As described above, inasmuch as the four-phase helical antenna having the axial direction in parallel with the principal surface 11*a* of the circuit board 12 is used as the antenna element 12 in this embodiment of the present invention, the antenna unit 10 can receive a GPS signal from a GPS satellite having a low angle of elevation although the antenna unit 10 is fixed or mounted on the car with an inclined state to the horizontal plane. Accordingly, it is possible to use the antenna unit 10 with the antenna unit 10 put on an inclined glass surface such as a rear window or a front window of the car. In addition, putting the antenna unit 10 on the glass surface may be carried out by using, for example, double-sided tape.

While this invention has thus far been described in conjunction with a preferred embodiment thereof, it will readily be possible for those skilled in the art to put this invention into practice in various other manners. For example, although the above-mentioned embodiment has been described only a case where the antenna unit is applicable to the GPS receiver, uses for the antenna unit is not limited to this. In addition, although the four-phase helical antenna is used as the helical antenna in the above-mentioned embodiment, the helical antenna is not restricted to this.

What is claimed is:

1. An antenna unit comprising:

a circuit board on which circuit elements are mounted, said circuit board having a principal surface; and an antenna element mounted on the principal surface of said circuit board and connected to said circuit elements, wherein said antenna element comprises a four-phase helical antenna having an axial direction which extends in a direction substantially parallel with the principal surface of said circuit board, and wherein said four-phase helical antenna receives circular polarization and comprises a cylindrical member made of an insulator and four antenna leads wound around an outer peripheral surface of said cylindrical member in a helix fashion.

2. An antenna unit as claimed in claim 1, wherein said circuit elements include a low-noise amplifier (LNA) circuit.

3. An antenna unit comprising:

a circuit board having a principal surface and a back surface opposite to the principal surface;

circuit elements arranged on the back surface of said circuit board;

an antenna element mounted on the principal surface of said circuit board and connected to said circuit elements, said antenna element comprising a four-phase helical antenna having an axial direction which extends in a direction substantially parallel to the principal surface of said circuit board; and a shield cover, added to the back surface of said circuit board so as to cover said circuit elements, for shielding said circuit elements, wherein said four-phase helical antenna receives circular polarization and comprises a cylindrical member made of an insulator and four antenna leads wound around an outer peripheral surface of said cylindrical member in a helix fashion.

4. An antenna unit as claimed in claim 3, wherein said circuit elements include a low-noise amplifier (LNA) circuit.

5. An antenna unit comprising:

a circuit board having a principal surface and a back surface opposite to the principal surface;

circuit elements arranged on the back surface of said circuit board;

an antenna element mounted on the principal surface of said circuit board and connected to said circuit elements, said antenna element comprising a four-phase helical antenna having an axial direction which extends in a direction substantially parallel to the principal surface of said circuit board;

a shield cover, added to the back surface of said circuit board so as to cover said circuit elements, for shielding said circuit elements; and an output cable connected to said circuit elements inside said shield cover, said output cable being pulled out of said shield cover, wherein said four-phase helical antenna receives circular polarization and comprises a cylindrical member made of an insulator and four antenna leads wound around an outer peripheral surface of said cylindrical member in a helix fashion.

6. An antenna unit as claimed in claim 5, wherein said circuit elements include a low-noise amplifier (LNA) circuit.

* * * * *